US006503371B1

(12) United States Patent
Kinseher et al.

(10) Patent No.: US 6,503,371 B1
(45) Date of Patent: Jan. 7, 2003

(54) MANUFACTURE OF CELLULOSIC PARTICLES

(75) Inventors: Richard Kinseher, Kelheim/Donau (DE); Andrzej Marek Mackiewicz, Rugby (GB)

(73) Assignee: Acordis Kelheim GmbH, Kelheim (DE)

( * ) Notice: Subject to any disclaimer, the term of this patent is extended or adjusted under 35 U.S.C. 154(b) by 0 days.

(21) Appl. No.: 09/600,361

(22) PCT Filed: Jan. 14, 1999

(86) PCT No.: PCT/GB99/00030

§ 371 (c)(1), (2), (4) Date: Aug. 4, 2000

(87) PCT Pub. No.: WO99/36603

PCT Pub. Date: Jul. 22, 1999

(30) Foreign Application Priority Data

Jan. 15, 1998 (GB) ..... 9800847

(51) Int. Cl.[7] ..... D21H 17/00; D21H 27/00

(52) U.S. Cl. ..... 162/157.6; 162/157.7; 162/182; 162/164.1

(58) Field of Search ..... 162/29, 157.6, 162/157.7, 182, 190, 164.1; 106/163.1, 166.01; 260/212

(56) References Cited

U.S. PATENT DOCUMENTS 3,114,747 A * 12/1963 Campbell ..... 260/212

6,063,237 A * 5/2000 Adams et al. ..... 162/29

FOREIGN PATENT DOCUMENTS

| | | |
|---|---|---|
| EP | 692559 | 1/1996 |
| EP | 824105 | 2/1998 |
| EP | 824106 | 2/1998 |
| GB | 1002621 | 8/1965 |
| GB | 1342805 | 1/1974 |
| WO | WO 96/26220 | 8/1996 |
| WO | WO 99/36602 | 7/1999 |
| WO | WO 99/36604 | 7/1999 |

OTHER PUBLICATIONS

Philipp et al., "Über Symplexe von Cellulosederivaten", *Faserforschung und Textiltechnik*, vol. 17, pp. 299–304, Jul. 1966.

Dawdyff et al., "Polyelektrolyt–Tensidionen–Komplexe (Literaturübersicht)", *Acta Polymerica*, vol. 38, No. 5, pp. 307–313, May 1987.

Philipp et al., "Polyelectrolyte Complexes—Recent Developments and Open House Problems", *Prog. Polym. Sci.*, vol. 14, pp. 91–171, 1989 (month unknown).

* cited by examiner

*Primary Examiner*—Dean T. Nguyen
(74) *Attorney, Agent, or Firm*—Howson and Howson

(57) ABSTRACT

Cellulosic fibrids can be made by mixing together under turbulent conditions viscose and a coagulating and regenerating liquor so as to form a suspension of soft macroscopic cellulosic particles in a spent liquor, collecting the particles, and comminuting them to form the fibrids.

24 Claims, No Drawings

MANUFACTURE OF CELLULOSIC PARTICLES

FIELD OF THE INVENTION

This invention relates to methods for the manufacture of cellulosic particles of the kind known as fibrids.

Cellulosic fibrids can be made by mixing together under turbulent conditions a spinning solution of cellulose and a coagulating liquor. One example of such a solution is viscose, which contains sodium cellulose xanthate. Examples of coagulating liquors for viscose include aqueous salt solutions and aqueous acid solutions. The fibrids so produced comprise, often predominantly, fine fibrous particles a few microns in diameter; of comparable size to the fibres in woodpulp. These fibrids may also comprise plate-like or globular particles of similar size to those fibres and of more or less irregular shape. For example, in the familiar salt figure test for viscose ripeness, viscose is mixed with aqueous sodium chloride. If the sodium chloride concentration is too low, a solution is formed; if it is too high, a more or less coherent precipitated lump is formed; but at the correct concentration, fibrids are formed. The fibrids formed in the salt figure test contain residual xanthate groups. If such fibrids are acidified, or if an acidic coagulating liquor is used, then the xanthate groups are destroyed and cellulose is regenerated.

BACKGROUND ART

Modified cellulose particles have been proposed as additives in papermaking, in particular to assist in formation of the paper web (sheet) and in sludge dewatering. In a series of papers in Das Papier (1980, vol. 34, pp. 575–579; 1981, vol. 35, pp. V33–V38 and pp. 555–562; and 1983, vol. 37, pp. 181–185), Kaufer et al. disclose cationically-modified cellulose particles prepared by the reaction of woodpulp with reagents such as 3-chloro-2-hydroxypropyltrimethylammonium chloride and the use of such particles as additives in papermaking.

Philipp and Lang (Faserforschung und Textiltechnik, 1966, vol. 17, pp. 299–304) disclose the addition of poly (ethyleneimine) to diluted viscose and titration of the resulting mixture with aqueous acid. A precipitate formed at mildly or moderately alkaline pH (8–11), depending upon the exact experimental conditions. The precipitate was described as a floc, indicating that it was composed of fibrids. The first-formed precipitate was believed to comprise a salt of a polymeric cation (protonated poly (ethyleneimine)) and a polymeric anion (cellulose xanthate). The authors refer to such salts generically as "symplexes". Titration was continued until the mixture became acid (pH 3), and at least partial regeneration of cellulose xanthate to cellulose occurred, thus yielding cationically-modified cellulosic particles by a viscose process. Philipp and co-workers elsewhere propose the use of cationically-modified cellulose particles and symplexes as additives for use in papermaking (Dawydoff et al., Acta Polymerica, 1987, vol. 38, pp. 307–313, and Philipp et al., Progress in Polymer Science, 1989, vol. 14, pp. 91–172).

WO-A-96/26220 discloses a process in which a cationic polymer is added to diluted viscose and the resulting mixture is mixed with a coagulating and regenerating liquor such as dilute sulphuric acid to form cellulosic fibrids useful as additives in papermaking. The viscose was added to the coagulating liquor, or vice versa. The resulting slurry contained about 0.3, 0.5 or 1 percent of fibrids, and the fibrids were collected from it by filtration.

Cellulosic fibrids made from viscose may be collected from the aqueous slurry in which they are prepared by conventional methods such as settling, filtration and centrifugation. The cost of such collection varies generally in an inverse manner with the concentration of fibrids in the slurry. It is accordingly desirable on economic grounds to prepare slurries which contain high proportions of fibrids. Simple mixing, of the kind disclosed by Philipp and co-workers or in WO-A-96/26220, is not well-suited to the manufacture of slurries containing more than about 1 percent by weight of fibrids. These slurries are thick, semi-fluid, porridge-like materials which are difficult to mix. In consequence, addition of viscose to a preformed concentrated fibrid slurry carries the risk of coagulation occurring unevenly, resulting in the production of hard oversized particles rather than the desired fibrids. It is an object of the invention to provide a method of manufacturing fibrids wherein their collection from the aqueous slurry in which they are formed is simplified.

DISCLOSURE OF THE INVENTION

According to the present invention, there is provided a method for the manufacture of cellulosic fibrids by the viscose process, including the steps of:

(1) mixing together (a) viscose and (b) a coagulating and regenerating liquor under turbulent conditions, thereby forming a suspension of soft macroscopic cellulosic particles in a spent liquor;

(2) collecting the macroscopic particles from the spent liquor; and (3) comminuting the macroscopic particles to form the fibrids.

The expression "spent liquor" is used as a convenient name for the byproduct liquor produced in the method of the invention; it will be appreciated that this liquor often retains some coagulating and regenerating powers.

The method of the invention preferably includes the additional step of:

(4) recovering the spent liquor for reintroduction as coagulating and regenerating liquor into step (1).

It is known that grain-like macroscopic cellulosic particles can be formed when viscose is contacted with a conventional coagulating and regenerating liquor; for example, if such particles are formed during fibre spinning, they constitute the defect known as trash. Such particles are generally hard and intractable. It is important in the present invention to choose conditions under which soft macroscopic particles are formed. Such conditions can readily be determined by simple experiment. The conditions which can be varied to achieve the desired aim include such factors as the composition, viscosity and degree of ripeness of the viscose; the composition of the coagulating and regenerating liquor; and the degree of shear. The soft macroscopic particles may resemble overcooked rice grains or soft cooked spaghetti. These particles are soft and friable, and they disintegrate under hand pressure. Particles in the form of "rice grains" are typically from 3 to 10 mm in size. Particles in the form of "spaghetti", are typically from 3 to 5 mm in diameter and vary in length from 1 or 2 cm up to about 30 cm. The manufacture of particles in the form of "rice grains" is generally preferred, both for ease of collection and comminution and because fibrids from comminuted "rice grains" may have better properties than fibrids from comminuted "spaghetti".

As guidance, we have found it convenient to employ a conventional viscose suitable for fibre manufacture and, prior to its introduction into mixing step (1), to mix it with water in a weight ratio in the approximate range from 1:2 to 10:1, preferably from 1:1 to 5:1. The cellulose concentration of the thusly diluted viscose may conveniently be in the range from 3 to 8, preferably from 5 to 7, percent by weight. The ballfall viscosity of the thusly diluted viscose may be in the approximate range from 5 to 30 seconds. We have generally found that, with increasing dilution and consequently reducing viscosity, the morphology of the particles progressively changes from spaghetti-like through rice-like to true fibrids. The formation of true fibrids indicates that the degree of dilution was excessive. If desired, the conventional viscose may be diluted with a slightly acidic liquor, for example with a liquor which includes a proportion of spent bath; provided that this does not result in any undue precipitation. This may offer advantages in terms of process economy.

The coagulating and regenerating liquor may be any of those known for viscose processes, particularly aqueous acid. Conveniently, it is dilute aqueous sulphuric acid, which is the most usual acidic component in such liquors, preferably at a concentration in the range from 0.5 to 5, more preferably from 1 to 3.5, percent by weight. If desired, the liquor may contain conventional amounts of sodium sulphate (a byproduct of the process), for example up to 25 percent by weight. This is advantageous, because the liquor can accordingly be recovered for reintroduction into the process using conventional measures such as evaporation and crystallisation. We have found that the coagulating and regenerating liquor does not need to contain, and preferably contains little or no, auxiliary coagulating substances such as the zinc sulphate used in many processes for the manufacture of conventional viscose fibres, because the presence of such substances may detract from the desired softness of the macroscopic particles. Furthermore, the presence of such substances in the fibrids produced by the method of the invention may be undesirable in some end-uses, for environmental and/or technical reasons. If desired, the liquor may contain conventional surface-active agents as employed in other viscose processes.

The temperature of the coagulating and regenerating liquor is preferably in the range from 60 to 100° C., more preferably in the range from 80 to 95° C. Firstly, we have found that use of a high-temperature liquor tends to increase the softness and friability of the macroscopic particles. Secondly, use of high temperatures makes for rapid coagulation and regeneration. Thirdly, the use of high temperatures assists removal of byproduct carbon disulphide and hydrogen sulphide by degassing. Degassing may be assisted by injecting steam into the suspension or slurry resulting from mixing step (1). Such sulphur-containing byproducts may be collected or disposed of in conventional manner.

Mixing may be effected, for example, by causing streams of viscose and of coagulating and regenerating liquor to impinge in a mixing chamber, for example a Y-shaped chamber. It is an advantage of the invention that simple and inexpensive mixing means can be employed.

It will be appreciated that the choices for the viscose and for the coagulating liquor and for the turbulent mixing conditions are to some extent interdependent. For example, excessively vigorous mixing may result in undesirable early breakdown of the macroscopic particles. The operating conditions need to be chosen with such factors in mind.

The slurry resulting from mixing step (1) generally contains cellulose solids in an amount from 0.1 to 3, preferably from 1 to 2, percent by weight. Although high amounts are desirable for process economy, it will be appreciated that the stiffness of, and difficulty of handling, the slurry increase with increasing solid content, necessitating more work in mixing, and that excessive breakdown of the macroscopic particles is undesirable at this stage.

The macroscopic particles may be collected from the spent liquor by any convenient means, such as filtration or centrifugation. We have found that such macroscopic particles can be collected much more easily than can fibrids from slurries of similar concentrations, because the former dewater more readily.

It is generally desirable to wash the collected macroscopic particles free of acid. In a preferred embodiment of the invention, an alkali such as sodium hydroxide is added to the slurry produced in mixing step (1) to adjust its pH towards neutrality, for example in the range from 4 to 8. Neutral salts such as sodium sulphate are more readily removed by washing from regenerated cellulose than are inorganic acids or alkalis. It may be preferred to at least partially dewater the slurry before neutralisation, in the interests of economy.

The collected macroscopic particles may be dried if required; although in general it is preferable not to do so, but instead to collect and to store macroscopic particles as a cake containing about 10–25, often about 10–20, percent by weight solids.

The macroscopic particles can be comminuted to fibrids in any convenient manner. Conveniently, they may be supplied to a papermaker for comminution in conventional papermaking equipment for subjecting slurries to high shear, with or without dilution, prior to introduction into or as part of the papermaking process.

The cellulose in the viscose may be chemically modified (other than by xanthation). For example, alkali cellulose may be reacted with a cationising agent such as 3-chloro-2-hydroxypropyltrimethylammonium chloride to produce a cationised cellulose which can subsequently be made into viscose. Alternatively, the viscose may contain an additive whose presence is desired in the ultimate fibrids. Examples of such additives include cationic polymers. A preferred example of a cationic fibrid is one which contains a poly (vinylamine) as cationic polymer, as disclosed in EP-A-0, 692,599. Such fibrids may contain from 10 to 50, often from 10 to 25, percent of the cationic polymer by weight on cellulose. By such means, cationic fibrids useful as additives in papermaking, for example to assist in web (sheet) formation and in sludge dewatering, can be produced. Other examples of additives which may be included in the viscose include dyestuffs (including optical brightening agents) and pigments (including UV-active pigments).

Fibrids made by the method of the invention may be used in the manufacture of paper and board, including fine and speciality papers.

The invention is illustrated by the following Example, in which parts and proportions are by weight unless otherwise specified:

EXAMPLE

A conventional viscose (9% cellulose, 5.4% alkalinity, ballfall viscosity 50 seconds, ripeness 10–12° Ho) (65–75 parts) was mixed with an aqueous solution of a poly (vinylamine) (Catiofast PR8106, Trade Mark of BASF AG, 12% solution as supplied) and water (together, 35–25 parts) to give a mixture containing cellulose (concentration 5.85–6.75%) and poly(vinylamine) in the ratio 88:12. This mixture (approximate ballfall viscosity 20 seconds) at ambient temperature was injected through a nozzle of 3 mm diameter at about 500 ml/min into a mixing chamber as first stream. Aqueous sulphuric acid (2.7%) at 80° C. was injected through a nozzle of 4 mm diameter at 5–6 l/min into the mixing chamber as second stream to impinge at an angle of 120° with the first stream. The two streams mixed under turbulent conditions to yield precipitated cellulose particles, and the combined stream was diverted perpendicularly to the plane of the first and second streams into a stirred collecting vessel disposed below the mixing chamber. At the start of the experiment, the vessel contained 50 l of 2.7% aqueous sulphuric acid at 80° C. The temperature of the contents of the vessel was maintained during the experiment at 80° C. or above by steam injection. After injection of the two streams had been stopped, stirring was continued until the colour of the slurry in the vessel, initially brown, had turned to white, indicating effectively complete degassing. The slurry contained about 0.6% cellulosic solids, which were collected by centrifugation. They were of a size and had a texture resembling that of overcooked rice grains. They could be readily disintegrated by hand pressure or by high-shear mixing in dilute aqueous slurry to yield fibrids containing a high proportion of fibrous material, as could be seen under the microscope.

In a second experiment, 85 parts viscose were mixed with 15 parts aqueous poly(vinylamine) solution of appropriate concentration to give a mixture containing cellulose (concentration 7.65%) and poly(vinylamine) in the ratio 88:12. In this case, the collected cellulosic particles were of a stringy nature and had a texture resembling that of soft cooked spaghetti. More work was required for their disintegration than for the grains resulting from the first experiment, and the fibrids produced by disintegration contained a higher proportion of platelets.

In a third, comparative, experiment, 35 parts viscose were mixed with 65 parts aqueous poly(vinylamine) solution of is appropriate concentration to give a mixture containing cellulose (concentration 3.15%) and poly(vinylamine) in the ratio 88:12. In this case, fibrids were formed directly and proved relatively difficult to collect from the slurry containing them.

The cationic activity of the fibrids was assessed by adding excess aqueous solution of a water-soluble anionic polymer followed by back-titrating against an aqueous solution of a water-soluble cationic polymer. The reagent solutions were about 1 millinormal in strength. Typical cationic activities in milliequivalents per kg measured on the products described in this Example were 800–1100 ("rice grains", not disintegrated), 100–300("spaghetti", not disintegrated) and 900–1200 (conventionally-made fibrids) Disintegration of the "rice grains" and "spaghetti" resulted in small increases in cationic activity.

What is claimed is:

1. A method for the manufacture of cellulosic fibrids by the viscose process, including the steps of:

(1) mixing together (a) viscose and (b) a coagulating and regenerating liquor under turbulent conditions to form a suspension of soft, friable macroscopic cellulosic particles in a spent liquor;

(2) collecting the macroscopic particles from the spent liquor; and (3) comminuting the macroscopic particles to form the fibrids.

2. A method according to claim 1, additionally including the step of:

(4) recovering the spent liquor for reintroduction as coagulating and regenerating liquor into step (1).

3. A method according to claim 1, wherein the macroscopic particles are from 3 to 10 mm in size.

4. A method according to claim 1, wherein the cellulose content of the viscose is in the range from 3 to 8 percent by weight.

5. A method according to claim 4, wherein the cellulose content of the viscose is in the range from 5 to 7 percent by weight.

6. A method according to claim 1, wherein the ballfall viscosity of the viscose is in the range from 5 to 30 seconds.

7. A method according to claim 1, wherein the coagulating and regenerating liquor is an aqueous liquor containing from 0.5 to 5 percent by weight of sulphuric acid.

8. A method according to claim 7, wherein the aqueous liquor contains from 1 to 3.5 percent by weight of sulphuric acid.

9. A method according to claim 1, wherein the temperature of the coagulating and regenerating liquor is in the range from 60 to 100° C.

10. A method according to claim 9, wherein the temperature of the coagulating and regenerating liquor is in the range from 80 to 95° C.

11. A method according to claim 1, wherein the mixing step is performed by causing streams of the viscose and of the coagulating and regenerating liquor to impinge in a mixing chamber.

12. A method according to claim 1, further including the step of injecting steam into the suspension resulting from step (1).

13. A method according to claim 1, wherein the suspension resulting from step (1) contains an amount of cellulose solids in the range from 0.1 to 3 percent by weight.

14. A method according to claim 13, wherein the suspension resulting from step (1) contains an amount of cellulose solids in the range from 1 to 2 percent by weight.

15. A method according to claim 1, which further includes the step of adding sodium hydroxide to the suspension resulting from step (1) to adjust the pH of the suspension to a value in the range from 4 to 8.

16. A method according to claim 1, wherein the viscose contains a cationic polymer.

17. A method according to claim 16, wherein the cationic polymer is a poly(vinylamine).

18. A method according to claim 16, wherein the fibrids produced by the method contain from 10 to 50 percent by weight of the cationic polymer based on the weight of cellulose.

19. A method according to claim 18, wherein the fibrids produced by the method contain from 10 to 25 percent by weight of the cationic polymer based on the weight of cellulose.

20. A method according to claim 1, wherein the viscose contains at least one component selected from the group consisting of a dyestuff and a pigment.

21. A method according to claim 1, wherein the product of the collecting step (2) is in the form of a cake containing an amount of solids in the range from 10 to 25 percent by weight.

22. A method according to claim 1, wherein said macroscopic particles formed in said suspension during said mixing step are soft and friable to an extent that said particles readily disintegrate under hand pressure.

23. A method according to claim 22, wherein said macroscopic particles formed in said suspension during said mixing step are about 3 to 10 mm in length and of a size equivalent to an overcooked grain of rice.

24. A method according to claim 22, wherein said macroscopic particles formed in said suspension during said mixing step are about 3 to 5 mm in diameter, up to 30 cm in length, and of a size equivalent to a soft cooked strand of spaghetti.

* * * * *